US011076465B2

(12) United States Patent
Mai et al.

(10) Patent No.: US 11,076,465 B2
(45) Date of Patent: Jul. 27, 2021

(54) MULTI-SEGMENT LINEAR LED DRIVE CIRCUIT, DEVICE AND DRIVING METHOD

(71) Applicant: SHENZHEN SENDIS SEMICONDUCTOR CO., LTD, Shenzhen (CN)

(72) Inventors: Yanquan Mai, Shenzhen (CN); Bo Chen, Shenzhen (CN); Xunsheng Deng, Shenzhen (CN)

(73) Assignee: SHENZHEN SENDIS SEMICONDUCTOR CO., LTD, Shenzhen (CN)

( * ) Notice: Subject to any disclaimer, the term of this patent is extended or adjusted under 35 U.S.C. 154(b) by 0 days.

(21) Appl. No.: 17/077,137

(22) Filed: Oct. 22, 2020

(65) Prior Publication Data

US 2021/0168916 A1 Jun. 3, 2021

(30) Foreign Application Priority Data

Nov. 29, 2019 (CN) ..... 201911203144.6

(51) Int. Cl.
*H05B 45/36* (2020.01)
*H05B 45/44* (2020.01)

(52) U.S. Cl.
CPC ..... *H05B 45/44* (2020.01)

(58) Field of Classification Search
CPC ..... H05B 45/36; H05B 45/44; H05B 45/46; H05B 45/48; H05B 45/355; H05B 45/395; H05B 45/3725; Y02B 20/30
See application file for complete search history.

(56) References Cited

U.S. PATENT DOCUMENTS 8,901,854 B1 * 12/2014 Chiu ..... H05B 45/48 315/308
9,295,117 B2 * 3/2016 Acatrinei ..... H05B 45/385
9,380,666 B2 * 6/2016 Lan ..... H05B 45/46

* cited by examiner

*Primary Examiner* — Haissa Philogene
(74) *Attorney, Agent, or Firm* — Maier & Maier, PLLC

(57) ABSTRACT

A multi-segment linear LED drive circuit, device and method. A Multi-segment linear LED drive circuit includes a reference voltage input module, current source module, voltage control module, current regulation module, at least two LED light strings connected in series and at least two driving modules correspondingly. The reference voltage input module provides reference voltage for each of driving module; the current source module provides DC current for voltage control module; the voltage control module controls input voltage of driving module according to DC current; the driving module lights corresponding LED light string on or off according to reference voltage, input voltage and line voltage constant current; the current adjusting module adjusts constant current; constant current of rear driving module is greater than that of front driving module, and when current passes through rear driving module, front driving module stops driving, harmonic influence and circuit implementation cost are reduced.

10 Claims, 7 Drawing Sheets

MULTI-SEGMENT LINEAR LED DRIVE CIRCUIT, DEVICE AND DRIVING METHOD

CROSS-REFERENCES TO RELATED APPLICATIONS

This application claims priority to Chinese Patent Application No. 201911203144.6, filed on Nov. 29, 2019, the content of all of which is incorporated herein by reference.

FIELD

The present disclosure relates to the technical field of LED, more particularly, to a multi-segment linear LED drive circuit, a device and a driving method thereof.

BACKGROUND

A single-segment linear constant current LED drive in the prior art, wherein a voltage of an LED string has to reach at least ⅔ of an output voltage from a rectifier bridge. While a high LED string voltage causes a current waveform flowing through the rectifier bridge seriously distorted, resulting in a power factor poor and a harmonic distortion large and an efficiency low.

A multi-segment linear constant current drive in the prior art needs to generate a plurality of reference voltages to control a current of each constant current source, comparing to the single-segment linear constant current LED drive, the efficiency, a value of the power factor and the harmonic distortion in a total are all improved, however, a distortion of a sub-harmonics still cannot meet a specification requirement, while generate a plurality of reference voltages will make a circuit implementation complicated. Increasing a number of segments of the LED string can partially solve the problem of the sub-harmonics. However, each time when increasing a segment of the LED string, a constant current source shall be added correspondingly, causing a circuit implementation cost increase.

Therefore, the current technology needs to be improved and developed.

SUMMARY

According to the above described defects, the purpose of the present disclosure is providing a multi-segment linear LED drive circuit, a device and a driving method thereof, by adopting a reference voltage to control the constant current source and simplifying a plurality of peripheral circuits, the harmonic influence is reduced at a same time of reducing a circuit implementation cost.

A technical solution of the present disclosure to solve the above technical problems is as follows:

A multi-segment linear LED drive circuit, comprising a reference voltage input module, a current source module, a voltage control module, a current regulation module, at least two LED light strings connected in series, and at least two driving modules corresponding to the LED light strings; the reference voltage input module is applied to providing a reference voltage for each of the driving modules; the current source module is applied to providing a DC current for the voltage control module; the voltage control module is applied to controlling an input voltage of the driving module according to the DC current; the driving module is applied to driving a corresponding LED light string to light on or off according to the reference voltage, the input voltage and a line voltage constant current; the current regulation module is applied to regulating a constant current passing through the corresponding LED light string; wherein, the constant current of a rear driving module is greater than the constant current of a front driving module, and when the rear driving module has a current passing, the front driving module stops driving.

The multi-segment linear LED drive circuit, wherein the voltage control module comprises a resistor string, the resistor string comprises a plurality of resistors connected in series, an upper end of the resistor string is connected to the current source module, and a lower end of the resistor string is connected to the current regulation module, an upper connector of each resistor is connected to each input voltage end of the driving modules respectively.

The multi-segment linear LED drive circuit, wherein the reference voltage input module comprises a reference voltage source which is applied to outputting a constant reference voltage to the driving modules.

The multi-segment linear LED drive circuit, wherein the reference voltage input module comprises a voltage dividing unit which divides a line voltage before outputting a reference voltage to the driving module, the reference voltage changes synchronously with the line voltage.

The multi-segment linear LED drive circuit, wherein the voltage dividing unit comprises a first resistor and a second resistor, one end of the first resistor is connected to a line voltage input end, another end of the first resistor is connected to one end of the second resistor and each of the driving modules, another end of the second resistor is grounded.

The multi-segment linear LED drive circuit, wherein the driving module comprises a first operational amplifier, a second operational amplifier, a third operational amplifier, a fourth operational amplifier, a first MOS transistor, a second MOS transistor, a third MOS transistor and a fourth MOS transistor; the voltage control module comprises a third resistor, a fourth resistor, and a fifth resistor;

a non-inverting input terminal of the first operational amplifier, a non-inverting input terminal of the second operational amplifier, a non-inverting input terminal of the third operational amplifier and a non-inverting input terminal of the fourth operational amplifier are all connected to a positive pole of the reference voltage source; an inverting input terminal of the first operational amplifier is connected to the current source module and one end of the third resistor, another end of the third resistor is connected to one end of the fourth resistor and an inverting input terminal of the second operational amplifier; another end of the fourth resistor is connected to one end of the fifth resistor and an inverting input terminal of the third operational amplifier; another end of the fifth resistor is connected to an inverting input terminal of the fourth operational amplifier and the current regulation module; an output terminal of the first operational amplifier is connected to a gate of the first MOS transistor, a drain of the first MOS transistor, a drain of the second MOS transistor, a drain of the third MOS transistor, and a drain of the fourth MOS transistor are all connected to an output terminal of the LED light strings; a source of the first MOS transistor, a source of the second MOS transistor, a source of the third MOS transistor, and a source of the fourth MOS transistor are all connected to the current regulation module; an output terminal of the second operational amplifier is connected to a gate of the second MOS transistor, an output terminal of the third operational amplifier is connected to a gate of the third MOS transistor, and an output terminal of the fourth operational amplifier is connected to a source of the fourth MOS transistor.

The multi-segment linear LED drive circuit, wherein the driving module comprises a fifth operational amplifier, a sixth operational amplifier, and a seventh operational amplifier; the voltage control module comprises a sixth resistor and a seventh resistor;

a non-inverting input terminal of the fifth operational amplifier, a non-inverting input terminal of the sixth operational amplifier, and a non-inverting input terminal of the seventh operational amplifier are all connected to another end of the first resistor and one end of the second resistor, an inverting input end of the fifth operational amplifier is connected to the current source module and one end of the sixth resistor, another end of the sixth resistor is connected to one end of the seventh resistor and an inverting input terminal of the sixth operational amplifier, another end of the seventh resistor is connected to an inverting input terminal of the seventh operational amplifier and the current regulation module; an output terminal of the fifth operational amplifier is connected to a gate of the fifth MOS transistor, an output terminal of the sixth operational amplifier is connected to a gate of the sixth MOS transistor, and the output terminal of the seventh operational amplifier is connected to a gate of the seventh MOS transistor; a source of the fifth MOS transistor, a source of the sixth MOS transistor, and a source of the seventh MOS transistor are all connected to the current regulation module; a drain of the fifth MOS transistor, a drain of the sixth MOS transistor, and a drain of the seventh MOS transistor are connected to an output end of each LED light string respectively.

The multi-segment linear LED drive circuit, wherein the current regulation module comprises a constant current resistor, one end of the constant current resistor is connected to the voltage control module and the driving module, another end of the constant current resistor is grounded.

A driving method of the multi-segment linear LED drive circuit according to what is described above, wherein comprising following steps:

providing a reference voltage for each of the driving modules by the reference voltage input module;

providing a DC current for the voltage control module by the current source module;

controlling an input voltage of the driving module by the voltage control module according to the DC current;

driving the corresponding LED light string to light on or off by the driving module according to the reference voltage, the input voltage, and the line voltage constant current; wherein, the constant current of the rear driving module is greater than the constant current of the front driving module, and when the rear driving module has a current passing, the front driving module stops driving;

regulating the constant current passing through the corresponding LED light string by the current regulation module.

A multi-segment linear LED drive device, comprising the multi-segment linear LED drive circuit described above.

Comparing to the prior art, the present disclosure provides a multi-segment linear LED drive circuit, a device and a driving method thereof, the multi-segment linear LED drive circuit comprises a reference voltage input module, a current source module, a voltage control module, a current regulation module, at least two LED light strings connected in series, and at least two driving modules corresponding to the LED light strings; the reference voltage input module is applied to providing a reference voltage for each of the driving modules; the current source module is applied to providing a DC current for the voltage control module; the voltage control module is applied to controlling an input voltage of the driving module according to the DC current; the driving module is applied to driving a corresponding LED light string to light on or off according to the reference voltage, the input voltage and the line voltage constant current; the current regulation module is applied to regulating the constant current passing through the corresponding LED light string; wherein, the constant current of the rear driving module is greater than the constant current of the front driving module, and when the rear driving module has the current passing, the front driving module stops driving. By adopting the reference voltage to control the constant current source and simplifying a plurality of peripheral circuits, the harmonic influence is reduced at a same time of reducing a circuit implementation cost.

DETAILED DESCRIPTION OF EMBODIMENTS

According to the above described defects, the purpose of the present disclosure is providing a multi-segment linear LED drive circuit, a device and a driving method thereof, by adopting a reference voltage to control the constant current source and simplifying a plurality of peripheral circuits, the harmonic influence is reduced at a same time of reducing a circuit implementation cost.

In order to make the purpose, technical solution and the advantages of the present disclosure clearer and more explicit, further detailed descriptions of the present disclosure are stated here, referencing to the attached drawings and some embodiments of the present disclosure. It should be understood that the detailed embodiments of the disclosure described here are used to explain the present disclosure only, instead of limiting the present disclosure.

Figure 1:
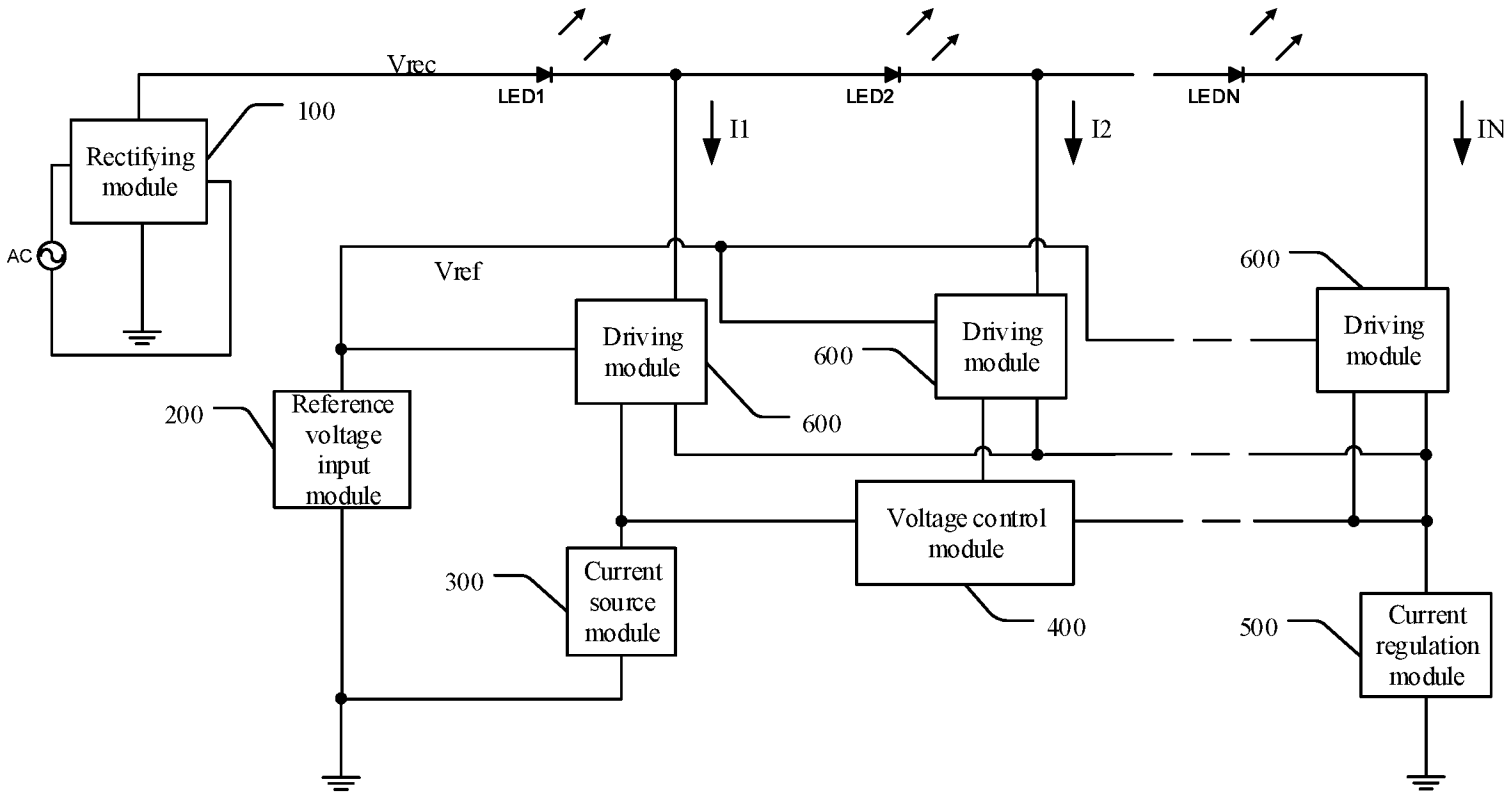
FIG. 1 illustrates a block diagram of a multi-segment linear LED drive circuit provided by the present disclosure.

Referencing to FIG. 1, the present disclosure provides a multi-segment linear LED drive circuit, comprising a rectifying module 100, a reference voltage input module 200, a current source module 300, a voltage control module 400, a current regulation module 500, at least two LED light strings connected in series, and at least two driving modules 600 corresponding to the LED light strings; an input end of the rectifying module 100 is connected to an AC power source, an output end of the rectifying module 100 is connected to an input end of the LED light string, and an output end of each LED light string is connected to an input end of the driving module 600, the input end of the driving module 600 is also connected to the reference voltage input module 200 and the voltage control module 400, and an output terminal of the driving module 600 is connected to the current regulation module 500.

The present disclosure, wherein the rectifying module 100 rectifies an AC power provided by the AC power source, before outputting a line voltage to the driving module 600 after passing through the LED string; the reference voltage input module 200 is applied to providing a reference voltage for each of the driving modules 600, and the reference voltage may be a constant DC voltage or a periodic voltage signal synchronized with the line voltage output from the rectifying bridge module 100; the current source module 300 is applied to providing a DC current for the voltage control module 400; the voltage control module 400 is applied to controlling an input voltage of the driving module 600 according to the DC current, the DC current passes through the voltage control module 400, and controls two adjacent driving modules 600 to maintain a constant voltage difference by the voltage control module 400; the driving module 600 is applied to driving a corresponding LED light string to light on or off in a constant current according to the reference voltage and the input voltage, controlling the current passing through the corresponding LED light string constant; the current regulation module 500 is applied to regulating the constant current passing through the corresponding LED light string, and controlling a maximum constant current passing through the LED light string; wherein the constant current of a rear driving module 600 is greater than the constant current of a front driving module 600, and when the rear driving module 600 has a current passing, the front driving module 600 stops driving; therefore using one reference voltage to control a plurality of driving modules 600 can contribute to a high efficiency, while additional sampling circuit is not required, not only is the complexity of a plurality of peripheral circuits reduced, but also the cost is reduced.

Figure 2:
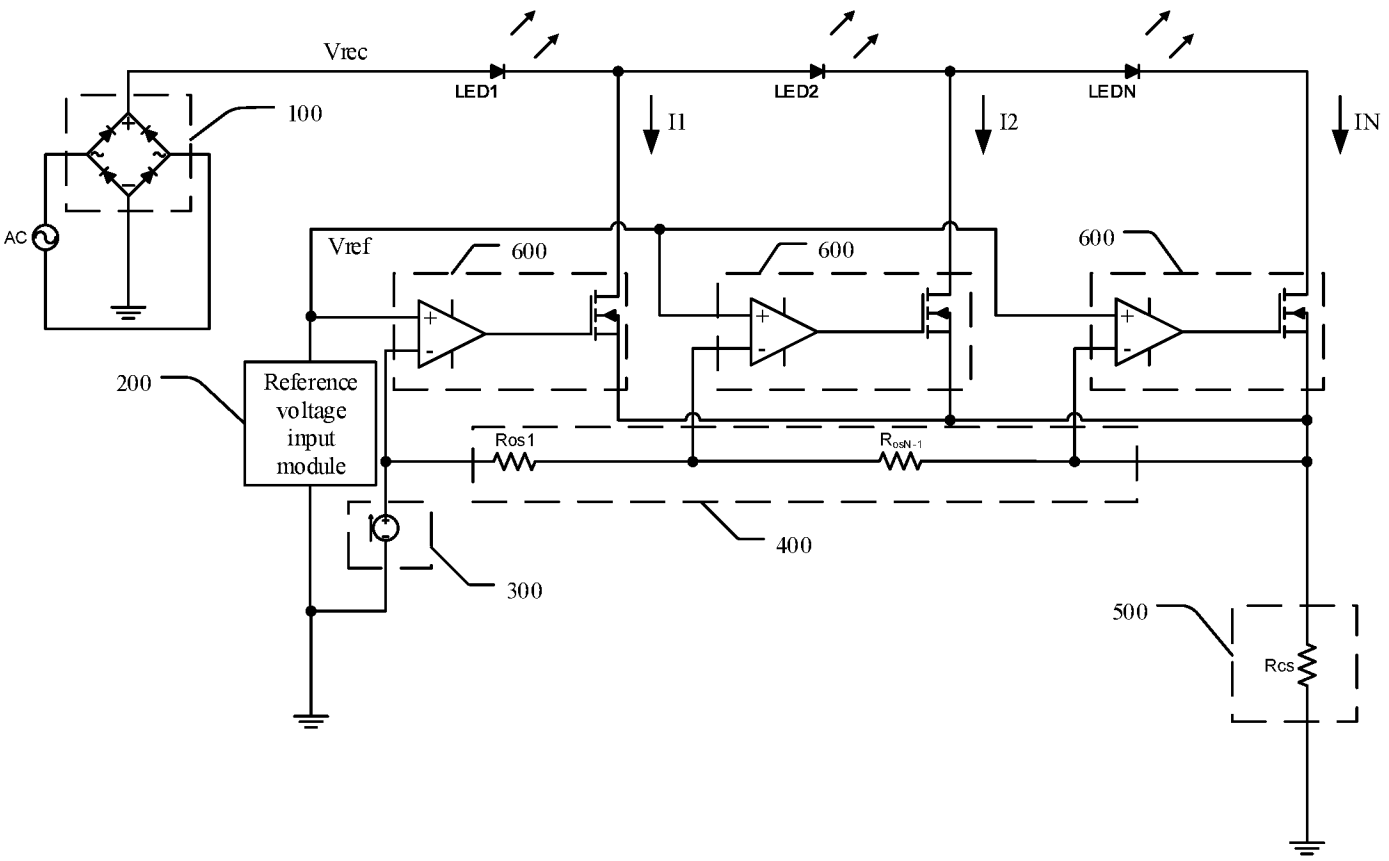
FIG. 2 illustrates a circuit schematic diagram of the multi-segment linear LED drive circuit provided by the present disclosure.

Further, referencing to FIG. 2, the voltage control module 400 comprises a resistor string, the resistor string comprises a plurality of resistors connected in series, an upper end of the resistor string is connected to the current source module 300, and a lower end of the resistor string is connected to the current regulation module 500, an upper connector of each resistor has an input voltage end connected, the input voltage end is connected to each of the driving modules 600 respectively, the current source module 300 provides a DC current and passes through each resistor in the resistor string, before further obtaining a corresponding voltage, controlling the input voltage of each driving module 600 through a voltage of each resistor, further making an input voltage between adjacent driving modules 600 keep a fixed voltage difference.

Further, the current regulation module 500 comprises a constant current resistor, one end of the constant current resistor is connected to the voltage control module 400 and the driving module 600, another end of the constant current resistor is grounded, regulating the constant current passing through each driving module 600 by setting a resistance value of the constant current resistor.

Recording the DC current as Ios, the reference voltage as Vref, the line voltage as Vrec, each LED light string as LED1, LED2, LED3, . . . , LEDN; the constant current of each driving module 600 is I1, I2, I3, . . . , IN, each resistor in the resistor string is Ros1, Ros2, Ros3, . . . , RosN−1, the constant resistor as Rcs, the voltage of the resistor in the resistor string is Vdif1, Vdif2, Vdif3, . . . , Vdifi; thus the constant current corresponding to each corresponding driving module 600 is:

$$I1=(Vref-\Sigma_{i=1}^{N-1}Vdifi)/Rcs-Ios;$$

$$I2=(Vref-\Sigma_{i=2}^{N-1}Vdifi)/Rcs-Ios;$$

$$IN=Vref/Rcs-Ios;$$

Due to Ios is much less than Vref/Rcs (at least two orders of magnitude), each item listed above may ignore Ios, which means:

$$I1=(Vref-\Sigma_{i=1}^{N-1}Vdifi)/Rcs$$

$$I2=(Vref-\Sigma_{i=2}^{N-1}Vdifi)/Rcs$$

IN=Vref/Rcs, wherein N is a positive integer larger than 1, i is a positive integer, Vdifi=Ios*Ros.

After the multi-segment linear LED drive circuit starts to work, when the line voltage Vrec output by the bridge rectifying module 100 is less than a conduction voltage Vled1 of the first light string of LED1, there is no current in the light string of LED1, and the light string of LED1 does not light on; when Vled1<Vrec<Vled1+Vled2, the LED1 lights on with a current of I1, and the Vled2 is a turn-on voltage of a light string of LED2; when the line voltage Vrec continues to increase to Vled1+Vled2<Vrec<Vled1+Vled2+Vled3, the LED1 and the LED2 are lit on with a current of I2, and the Vled3 is a turn-on voltage of the light string of LED3; at a same time, the front driving module 600, that is, the driving module 600 that provides the constant current I1 correspondingly shuts down and stops driving, and so on, following the line voltage Vrec increasing, more light strings are lit on, and the driving module 600 is turned off step by step; following the line voltage Vrec decreasing, less light LED strings are lit on, and the driving module 600 is turned on step by step, thereby a driving control for each LED light string is achieved. By setting a resistance value of each resistor in the resistance string, a waveform change of the constant current is close to a waveform of the line voltage Vrec, reducing a harmonic distortion, and improving a power factor.

Figure 3:
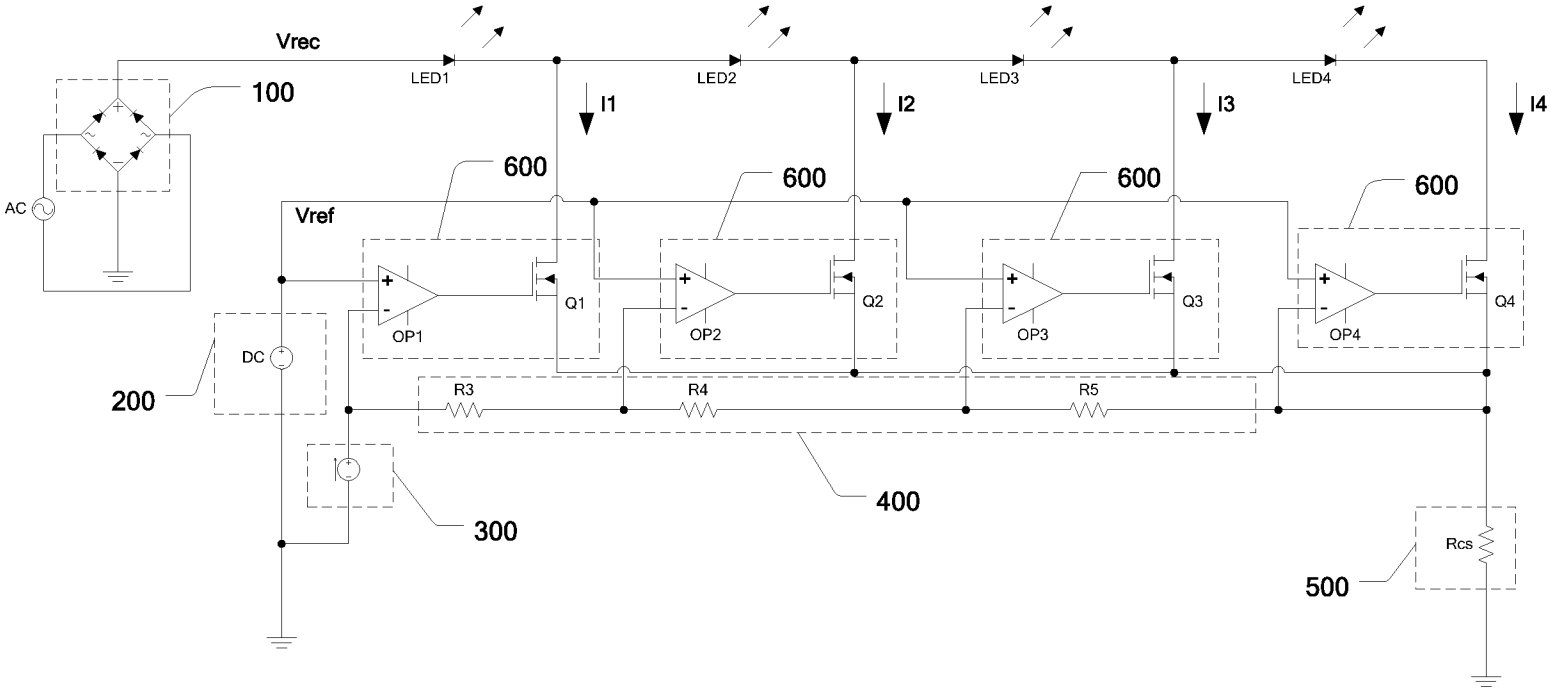
FIG. 3 illustrates a circuit schematic diagram of a first embodiment in the multi-segment linear LED drive circuit provided by the present disclosure.

In the first embodiment of the present invention, referencing to FIG. 3, wherein the reference voltage input module 200 comprises a reference voltage source, a positive pole of the reference voltage source is connected to each of the driving modules 600, and a negative pole of the reference voltage source is grounded. The reference voltage source is applied to outputting a constant reference voltage Vref to the driving module 600. A working principle of the multi-segment linear LED drive circuit is described by using 4 groups of LED light strings and 4 driving modules 600.

In the present embodiment, wherein the driving module 600 comprises a first operational amplifier OP1, a second operational amplifier OP2, a third operational amplifier OP3, a fourth operational amplifier OP4, a first MOS transistor Q1, a second MOS transistor Q2, a third MOS transistor Q3 and a fourth MOS transistor Q4; the voltage control module 400 comprises a third resistor R3, a fourth resistor R4, and a fifth resistor R5; a non-inverting input terminal of the first operational amplifier OP1, a non-inverting input terminal of the second operational amplifier OP2, a non-inverting input terminal of the third operational amplifier OP3 and a non-inverting input terminal of the fourth operational amplifier OP4 are all connected to a positive pole of the reference voltage source; an inverting input terminal of the first operational amplifier OP1 is connected to the current source module 300 and one end of the third resistor R3, another end of the third resistor R3 is connected to one end of the fourth resistor R4 and an inverting input terminal of the second operational amplifier OP2; another end of the fourth resistor R4 is connected to one end of the fifth resistor R5 and an inverting input terminal of the third operational amplifier OP3; another end of the fifth resistor R5 is connected to an inverting input terminal of the fourth operational amplifier OP4 and the current regulation module 500; an output terminal of the first operational amplifier OP1 is connected to a gate of the first MOS transistor Q1, a drain of the first MOS transistor Q1, a drain of the second MOS transistor Q2, a drain of the third MOS transistor Q3, and a drain of the fourth MOS transistor Q4 are all connected to an output terminal of each of the LED light strings; a source of the first MOS transistor Q1, a source of the second MOS transistor Q2, a source of the third MOS transistor Q3, and a source of the fourth MOS transistor Q4 are all connected to the current regulation module 500; an output terminal of the second operational amplifier OP2 is connected to a gate of the second MOS transistor Q2, an output terminal of the third operational amplifier OP3 is connected to a gate of the third MOS transistor Q3, and an output terminal of the fourth operational amplifier OP4 is connected to a source of the fourth MOS transistor Q4.

In the present embodiment, each of the driving module 600 controls the current passing through the corresponding LED light string to be constant according to a virtual short and virtual off characteristic of each operational amplifier. The current source module 300 provides the DC current Ios to the third resistor R3, the fourth resistor R4 and the fifth resistor R5, to control the input voltages respectively of the first operational amplifier OP1, the second operational amplifier OP2, and the third operational amplifier OP3, that is, the voltage on the inverting input terminal of each operational amplifier, while the constant current resistor Rcs is applied to controlling a negative terminal voltage of the fourth operational amplifier OP4, and able to control a maximum current passing through each LED string by setting a resistance value of the constant current resistor Rcs.

When Vrec<Vled1, the LED light strings have no current, and all LEDs are off.

When Vled1<Vrec<Vled+Vled2, the current in the LED light strings is Iled=I1=[Vref−(Vdif1+Vdif2+Vdif3)]/Rcs, the LED1 is lit on, at this point, the first operational amplifier OP1, due to the virtual short characteristic, the voltage on the non-inversing input terminal V1+ equals to the voltage on the inverting input terminal V1−, that is, V1+=V1−=Vref.

When Vled1+Vled2<Vrec<Vled+Vled2+Vled3, the current in the LED light strings is Iled=I2=[Vref−(Vdif2+Vdif3)]/Rcs, the LED1 and the LED2 are lit on, at this point, the second operational amplifier OP2, due to the virtual short characteristic, the voltage on the non-inversing input terminal V2+ equals to the voltage on the inverting input terminal V2−, that is, V2+=V2−=Vref, while the voltage on the inverting input terminal of the first operational amplifier OP1, V1−=Vref+Vdif1 is larger than the voltage on the non-inverting input terminal V1+=Vref, thus the first MOS transistor Q1 is turned off.

When Vled1+Vled2+Vled3<Vrec<Vled+Vled2+Vled3+Vled4, the current in the LED light strings is Iled=I3=(Vref−Vdif3)/Rcs, the LED1, the LED2 and the LED3 are lit on, at this point, the voltage on the inverting input terminal of the second operational amplifier OP2 is larger than the voltage on the non-inverting input terminal, thus the second MOS transistor Q2 is turned off.

When Vled1+Vled2+Vled3+Vled4<Vrec, the current in the LED light strings is Iled=I4=Vref/Rcs, the LED1, the LED2, the LED3 and the LED4 are all lit on, accordingly, the third MOS transistor Q3 is turned off, wherein Vdif1=Ios*R3; Vdif2=Ios*R4; Vdif3=Ios*R5.

Figure 4:
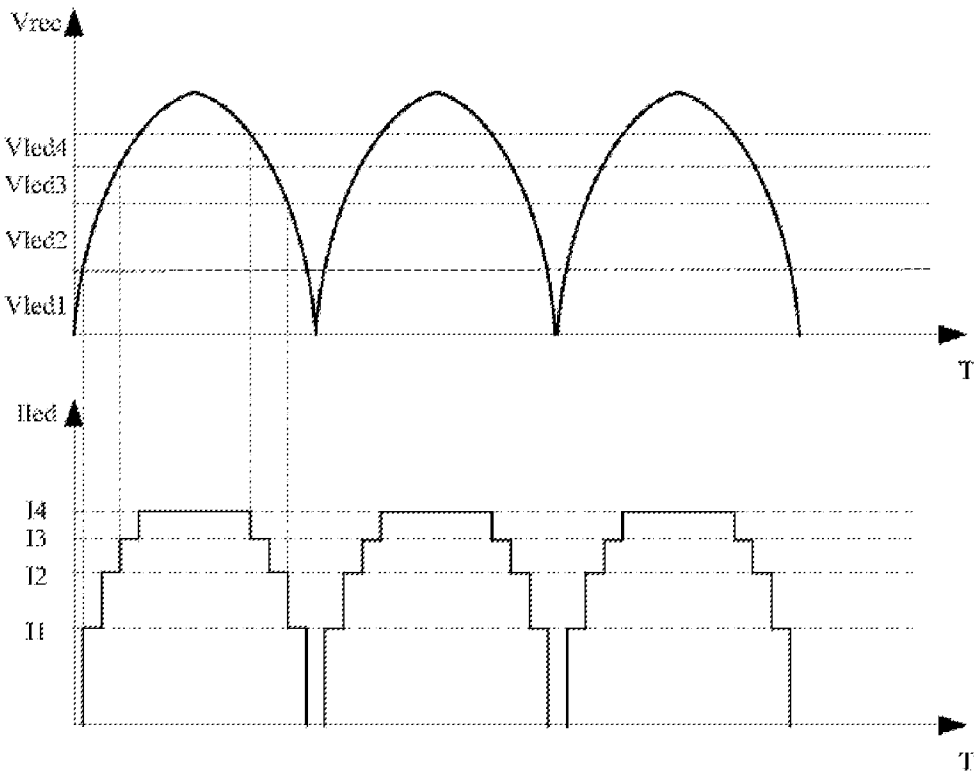
FIG. 4 illustrates a waveform diagram on a line voltage and a constant current of an LED light string in the first embodiment of the multi-segment linear LED drive circuit provided by the present disclosure.

Because the reference voltage source only needs to generate a constant DC low voltage as the reference voltage Vref, in a plurality of applications that requires a high efficiency but not high harmonic distortion, through a value of the constant current resistance Rcs, it is possible to obtain a maximum current of the LED light string I4=Vref/Rcs, after setting a plurality of values of the resistors R3−R5, the currents of I1, I2, and I3 are determined and satisfying I1<I2<I3<I4. The values of the resistors R3−R5 determine the Vdif1−Vdif3, and the Vdif1−Vdif3 determine a change of the lied. By setting the values of the resistors of R3-R5, Iled is made closer to the waveform of the line voltage Vrec (as shown in FIG. 4), in order to obtain a higher power factor and a lower harmonic distortion. After the resistance values of the resistors R3-R5 have been determined, they will not be changed any more, which is easier for system integration, and the chip PAD will be reduced after the integration, which benefits a PCB route.

Figure 5:
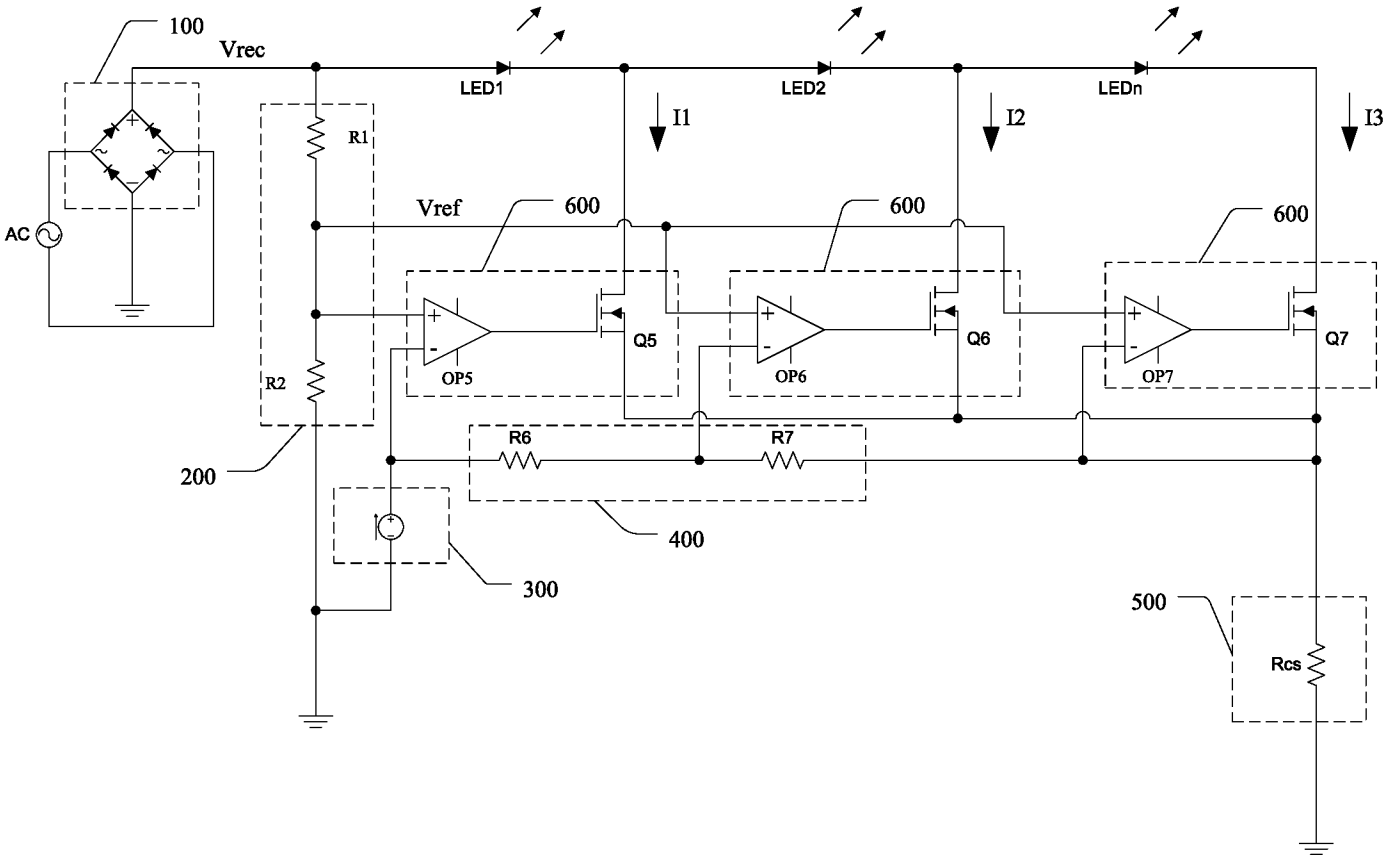
FIG. 5 illustrates a circuit schematic diagram of a second embodiment in the multi-segment linear LED drive circuit provided by the present disclosure.

A second embodiment of the present disclosure, referencing to FIG. 5, wherein the reference voltage input module 200 comprises a voltage dividing unit, the voltage dividing unit divides the line voltage Vrec before outputting a reference voltage Vref to the driving module 600, the reference voltage Vref changes synchronously with the line voltage Vrec, the voltage dividing unit comprises a first resistor R1 and a second resistor R2, one end of the first resistor R1 is connected to a line voltage input end, another end of the first resistor R1 is connected to the second resistor R2 and each of the driving modules 600, another end of the second resistor R2 is grounded, obtaining the reference voltage Vref changing synchronously with the line voltage Vrec after dividing the line voltage Vrec by the first resistor R1, so as to achieving a control to each driving module 600.

In the present embodiment, a working principle of the multi-segment linear LED drive circuit is described by using 3 groups of the LED light strings and 3 groups of driving modules 600.

Continue referencing to FIG. 5, the driving module 600 comprises a fifth operational amplifier OP5, a sixth operational amplifier OP6, and a seventh operational amplifier OP7; the voltage control module 400 comprises a sixth resistor R6 and a seventh resistor R7; a non-inverting input terminal of the fifth operational amplifier OP5, a non-inverting input terminal of the sixth operational amplifier OP6, and a non-inverting input terminal of the seventh operational amplifier OP7 are all connected to another end of the first resistor R1 and one end of the second resistor R2, an inverting input end of the fifth operational amplifier OP5 is connected to the current source module 300 and one end of the sixth resistor R6, another end of the sixth resistor R6 is connected to one end of the seventh resistor R7 and an inverting input terminal of the sixth operational amplifier OP6, another end of the seventh resistor R7 is connected to an inverting input terminal of the seventh operational amplifier OP7 and the current regulation module 500; an output terminal of the fifth operational amplifier OP5 is connected to a gate of the fifth MOS transistor Q5, an output terminal of the sixth operational amplifier OP6 is connected to a gate of the sixth MOS transistor Q6, and the output terminal of the seventh operational amplifier OP7 is connected to a gate of the seventh MOS transistor Q7; a source of the fifth MOS transistor Q5, a source of the sixth MOS transistor Q6, and a source of the seventh MOS transistor Q7 are all connected to the current regulation module 500; a drain of the fifth MOS transistor Q5, a drain of the sixth MOS transistor Q6, and a drain of the seventh MOS transistor Q7 are connected to an output end of each LED light string respectively.

Wherein, the reference voltage is generated by dividing the line voltage by the first resistor R1, before being input to a plurality of positive terminals of the fifth operational amplifier OP5, the sixth operational amplifier OP6, and the seventh operational amplifier OP7, the current source module 300 outputs a DC current to the sixth resistor R6 and the seventh resistor R7, controlling respectively the voltages on the inverting input terminals of the fifth operational amplifier OP5 and the sixth operational amplifier OP6, the constant current resistor Rcs may control the voltage of the inverting input terminal of the seventh operational amplifier OP7, and by setting a resistance value of the constant current resistor Rcs, a maximum current passing through each LED string may be controlled.

When Vrec<Vled1, the LED light strings have no current, and all LEDs are off.

When Vled1<Vrec<Vled+Vled2, the current in the LED light strings is Iled=I1=[Vref−(Vdif1+Vdif2)]/Rcs, the LED1 is lit on.

When Vled1+Vled2<Vrec<Vled+Vled2+Vled3, the current in the LED light strings is Iled=I2=(Vref−Vdif2)/Rcs, the LED1 and the LED2 are lit on, accordingly, the fifth MOS transistor Q5 is turned off.

When Vled1+Vled2+Vled3<Vrec, the current in the LED light strings is Iled=I3=Vref/Rcs, all the LED1, the LED2 and the LED3 are lit on, accordingly, the sixth MOS transistor Q6 is turned off; wherein Vdif1=Ios*R6; Vdif2=Ios*R7.

Figure 6:
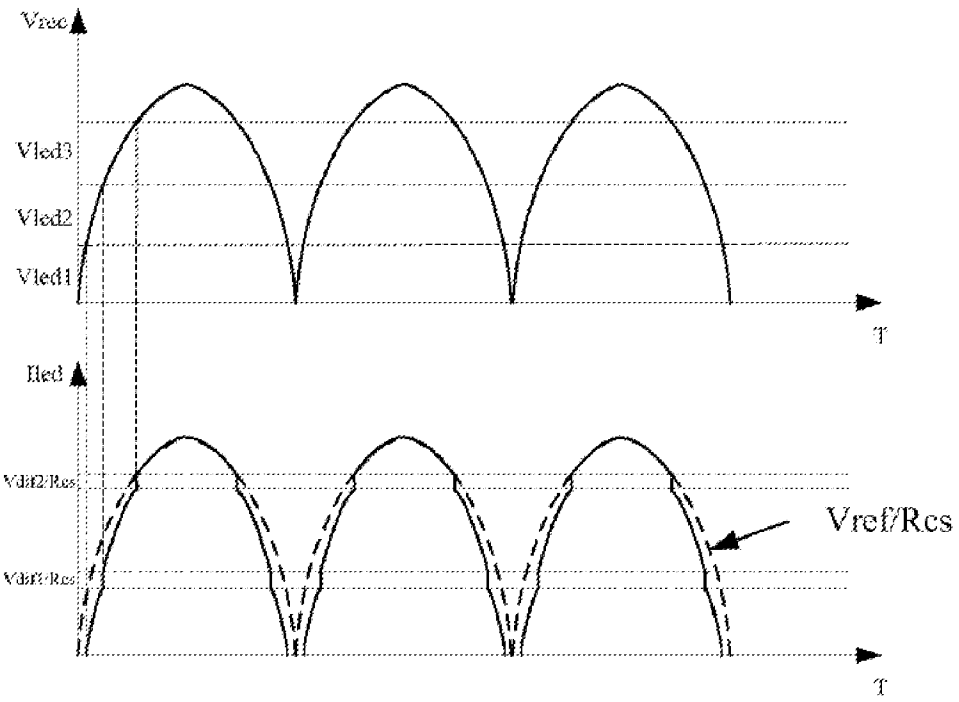
FIG. 6 illustrates a waveform diagram on a line voltage and a constant current of an LED light string in the second embodiment of the multi-segment linear LED drive circuit provided by the present disclosure.

Since the reference voltage is generated by dividing the line voltage Vrec, thus the reference voltage is synchronized with the line voltage Vrec, so the smaller Vdif1 and Vdif2 are, the closer a change of the Iled is to a waveform of the line voltage Vrec (shown as FIG. 6), the smaller the harmonic distortion is, and the higher the power factor is. However, due to a plurality of process errors in a mass production, an operational amplifier has an offset voltage Vosn, which has limited the Vdif1 and the Vdif2 from being infinitely small. When it is satisfied that the voltage Vn− of the inverting input terminal of the operational amplifier is greater than the voltage Vn+ of the non-inverting input terminal accordingly, it is able to ensure that turning off the current of a front LED string when a rear LED string has the current, that is, turning off a front MOS transistor as well. That requires a corresponding operational amplifier having a Vn−>Vn+, while Vn−=Vref+Vdifi−Vosn, Vn+=Vref, thus it is necessary to ensure that the Vdifi should be greater than the Vosn, and the Vdifi is related to a plurality of resistance values in the resistor string. When setting a resistance value of each resistor in the voltage control module 400, it should be ensured that a corresponding voltage thereof is greater than an offset voltage of the operational amplifier connected.

In the present embodiment, because the reference voltage Vref is generated by dividing the line voltage Vrec, the reference voltage Vref is synchronized with the line voltage Vrec, when the line voltage Vrec increases, the reference voltage Vref increases, the current Iled passing through the LED light string increases accordingly; when the line voltage Vrec decreases, the reference voltage Vref decreases, and the Iled decreases accordingly, the current Iled passing through the LED light string changes following the line voltage Vrec changes synchronously. Comparing to a method of improving the harmonic distortion by increasing a number of a plurality of LED light string segments, in the present embodiment, the harmonic distortion is better suppressed, the power factor is higher, and the circuit structure is simpler with a lower cost. Resistance values of the sixth resistor R6 and the seventh resistor R7 are only related to the offset voltage Vosn of the operational amplifier connected correspondingly, when the resistance values thereof have been determined, the resistance values will not change any more, which makes system integration easier, and a plurality of chip PADs are reduced after integration, that is easier for a PCB route. In a case of a same number of the LED strings, comparing to a solution of adopting a plurality of reference voltages, adopting a reference voltage Vref synchronized with the line voltage Vrec may get a better power factor, a lower harmonic distortion, and a plurality of sub-harmonics may also meet the requirement of various specifications, and no complicated extra sampling circuits in peripheral are required, a simple structure and a low implementation cost are obtained.

Figure 7:
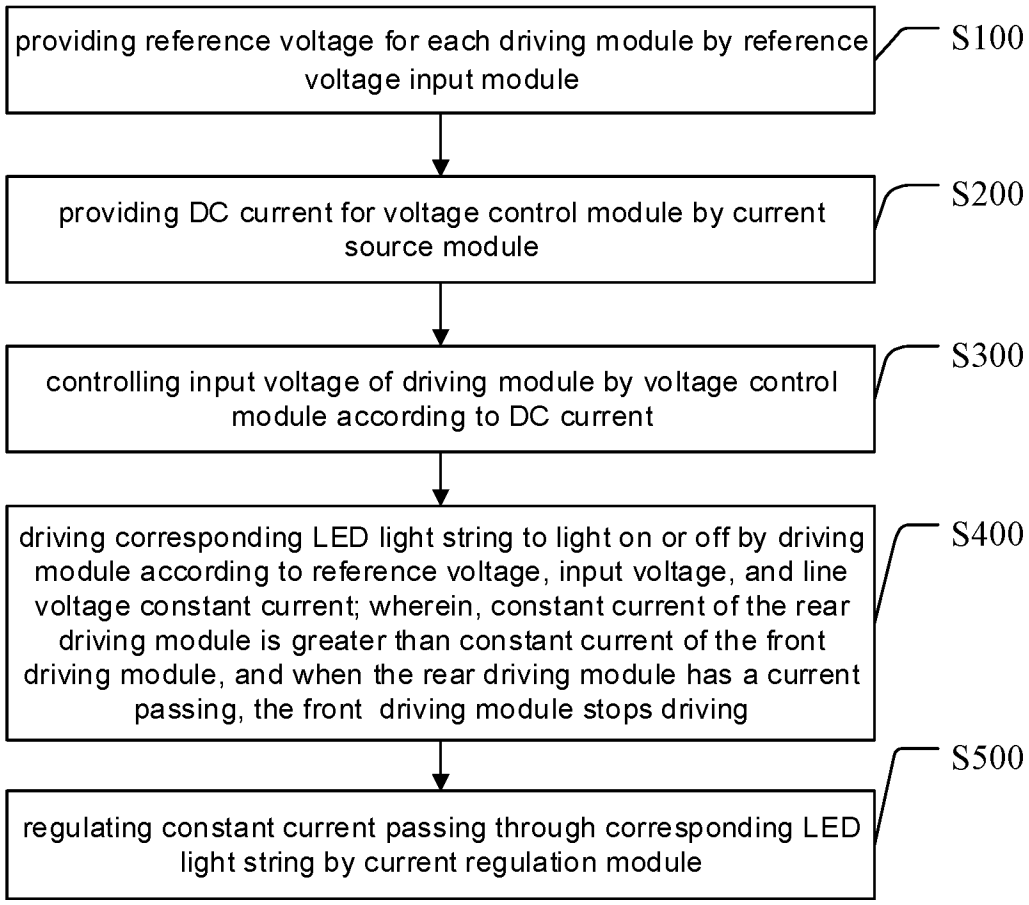
FIG. 7 illustrates a flowchart on a driving method of the multi-segment linear LED provided by the present disclosure.

The present disclosure further provides a driving method of the multi-segment linear LED, referencing to FIG. 7, comprising following steps:

S100, providing a reference voltage for each of the driving modules by the reference voltage input module;

S200, providing a DC current for the voltage control module by the current source module;

S300, controlling an input voltage of the driving module by the voltage control module according to the DC current;

S400, driving the corresponding LED light string to light on or off out by the driving module according to the reference voltage, the input voltage, and the line voltage constant current; wherein, the constant current of the rear driving module is greater than the constant current of the front driving module, and when the rear driving module has a current passing, the front driving module stops driving;

S500, regulating the constant current passing through the corresponding LED light string by the current regulation module.

Based on the LED drive circuit described above, the present disclosure further provides a multi-segment linear LED drive device, comprising the multi-segment linear LED drive circuit described above. Due to a detailed description for the multi-segment linear LED drive has been stated above, no more details will be described herein again.

All above, the present disclosure provides a multi-segment linear LED drive circuit, a device and a driving method thereof, the multi-segment linear LED drive circuit comprises a reference voltage input module, a current source module, a voltage control module, a current regulation module, at least two LED light strings connected in series, and at least two driving modules corresponding to the LED light strings; the reference voltage input module is applied to providing a reference voltage for each of the driving modules; the current source module is applied to providing a DC current for the voltage control module; the voltage control module is applied to controlling an input voltage of the driving module according to the DC current; the driving module is applied to driving a corresponding LED light string to light on or off according to the reference voltage, the input voltage and a line voltage constant current; the current regulation module is applied to regulating a constant current passing through the corresponding LED light string; wherein, the constant current of a rear driving module is greater than the constant current of a front driving module, and when the rear driving module has a current passing, the front driving module stops driving. By adopting a reference voltage to control the constant current source and simplifying a plurality of peripheral circuits, the harmonic influence is reduced at a same time of reducing a circuit implementation cost.

It should be understood that, the application of the present disclosure is not limited to the above examples listed. Ordinary technical personnel in this field can improve or change the applications according to the above descriptions, all of these improvements and transforms should belong to the scope of protection in the appended claims of the present disclosure.

What is claimed is:

1. A multi-segment linear LED drive circuit, comprising: a reference voltage input module, a current source module, a voltage control module, a current regulation module, at least two LED light strings connected in series, and at least two driving modules corresponding to the LED light strings; wherein the reference voltage input module is applied to provide a reference voltage for each of the driving modules; wherein the current source module is applied to provide a DC current for the voltage control module; wherein the voltage control module is applied to control an input voltage of the driving module according to the DC current; wherein the driving module is applied to drive a corresponding LED light string to light on or off according to the reference voltage, the input voltage and a line voltage constant current; and wherein the current regulation module is applied to regulate a constant current passing through the corresponding LED light string; wherein the constant current of a rear driving module is greater than the constant current of a front driving module, and when the rear driving module has a current passing, the front driving module stops driving.

2. The multi-segment linear LED drive circuit according to claim 1, wherein the voltage control module comprises a resistor string, the resistor string comprises a plurality of resistors connected in series, an upper end of the resistor string is connected to the current source module, and a lower end of the resistor string is connected to the current regulation module, an upper connector of each resistor is connected to each input voltage end of the driving modules, respectively.

3. The multi-segment linear LED drive circuit according to claim 1, wherein the reference voltage input module comprises a reference voltage source which is applied to output a constant reference voltage to the driving modules.

4. The multi-segment linear LED drive circuit according to claim 1, wherein the reference voltage input module comprises a voltage dividing unit which divides a line voltage before outputting a reference voltage to the driving module, the reference voltage changes synchronously with the line voltage.

5. The multi-segment linear LED drive circuit according to claim 4, wherein the voltage dividing unit comprises a first resistor and a second resistor, one end of the first resistor is connected to a line voltage input end, another end of the first resistor is connected to one end of the second resistor and each of the driving modules, another end of the second resistor is grounded.

6. The multi-segment linear LED drive circuit according to claim 3, wherein the driving module comprises a first operational amplifier, a second operational amplifier, a third operational amplifier, a fourth operational amplifier, a first MOS transistor, a second MOS transistor, a third MOS transistor and a fourth MOS transistor; and the voltage control module comprises a third resistor, a fourth resistor, and a fifth resistor; and a non-inverting input terminal of the first operational amplifier, a non-inverting input terminal of the second operational amplifier, a non-inverting input terminal of the third operational amplifier and a non-inverting input terminal of the fourth operational amplifier are all connected to a positive pole of the reference voltage source; an inverting input terminal of the first operational amplifier is connected to the current source module and one end of the third resistor, another end of the third resistor is connected to one end of the fourth resistor and an inverting input terminal of the second operational amplifier; another end of the fourth resistor is connected to one end of the fifth resistor and an inverting input terminal of the third operational amplifier; another end of the fifth resistor is connected to an inverting input terminal of the fourth operational amplifier and the current regulation module; an output terminal of the first operational amplifier is connected to a gate of the first MOS transistor, a drain of the first MOS transistor, a drain of the second MOS transistor, a drain of the third MOS transistor, and a drain of the fourth MOS transistor are all connected to an output terminal of the LED light strings; a source of the first MOS transistor, a source of the second MOS transistor, a source of the third MOS transistor, and a source of the fourth MOS transistor are all connected to the current regulation module; an output terminal of the second operational amplifier is connected to a gate of the second MOS transistor, an output terminal of the third operational amplifier is connected to a gate of the third MOS transistor, and an output terminal of the fourth operational amplifier is connected to a source of the fourth MOS transistor.

7. The multi-segment linear LED drive circuit according to claim 5, wherein the driving module comprises a fifth operational amplifier, a sixth operational amplifier, and a seventh operational amplifier; and the voltage control module comprises a sixth resistor and a seventh resistor; and a non-inverting input terminal of the fifth operational amplifier, a non-inverting input terminal of the sixth operational amplifier, and a non-inverting input terminal of the seventh operational amplifier are all connected to another end of the first resistor and one end of the second resistor, an inverting input end of the fifth operational amplifier is connected to the current source module and one end of the sixth resistor, another end of the sixth resistor is connected to one end of the seventh resistor and an inverting input terminal of the sixth operational amplifier, another end of the seventh resistor is connected to an inverting input terminal of the seventh operational amplifier and the current regulation module; an output terminal of the fifth operational amplifier is connected to a gate of the fifth MOS transistor, an output terminal of the sixth operational amplifier is connected to a gate of the sixth MOS transistor, and the output terminal of the seventh operational amplifier is connected to a gate of the seventh MOS transistor; a source of the fifth MOS transistor, a source of the sixth MOS transistor, and a source of the seventh MOS transistor are all connected to the current regulation module; a drain of the fifth MOS transistor, a drain of the sixth MOS transistor, and a drain of the seventh MOS transistor are connected to an output end of each LED light string respectively.

8. The multi-segment linear LED drive circuit according to claim 1, wherein the current regulation module comprises a constant current resistor, one end of the constant current resistor is connected to the voltage control module and the driving module, and another end of the constant current resistor is grounded.

9. A driving method of the multi-segment linear LED drive circuit according to claim 1, comprising:

providing a reference voltage for each of the driving modules by the reference voltage input module;

providing a DC current for the voltage control module by the current source module;

controlling an input voltage of the driving module by the voltage control module according to the DC current;

driving the corresponding LED light string to light on or off by the driving module according to the reference voltage, the input voltage, and the line voltage constant current; wherein, the constant current of the rear driving module is greater than the constant current of the front driving module, and when the rear driving module has a current passing, the front driving module stops driving; and regulating the constant current passing through the corresponding LED light string by the current regulation module.

10. A multi-segment linear LED drive device, comprising the multi-segment linear LED drive circuit according to claim 1.

* * * * *